United States Patent [19]

Westberg

[11] 4,196,536

[45] Apr. 8, 1980

[54] POSTING DEVICE AND METHOD

[76] Inventor: Aake G. Westberg, Ljuslinsvägen lo, S 852 54 Sundsvall, Sweden

[21] Appl. No.: 743,496

[22] Filed: Nov. 19, 1976

Related U.S. Application Data

[63] Continuation of Ser. No. 520,900, Nov. 4, 1974, abandoned.

[30] Foreign Application Priority Data

Nov. 5, 1973 [FR] France ..... 73 39176

[51] Int. Cl.[2] ..... G09F 1/10

[52] U.S. Cl. ..... 40/159; 40/537

[58] Field of Search ..... 24/67.11; 211/89; 248/316 D; 40/11, 23 R, 124.2, 159, 537

[56] References Cited

U.S. PATENT DOCUMENTS

| | | | |
|---|---|---|---|
| 886,320 | 4/1908 | Ferrero | 40/124.2 |
| 1,817,424 | 8/1931 | Smiley | 24/67.11 |
| 2,437,415 | 3/1948 | Berry | 40/124.2 |
| 2,861,369 | 11/1958 | Widmaier | 40/159 |
| 3,229,394 | 1/1966 | Purdy | 40/16 R |
| 3,245,166 | 4/1966 | Hagner | 40/159 |
| 3,862,323 | 12/1958 | Mascolo | 40/159 |

*Primary Examiner*—Louis G. Mancene
*Assistant Examiner*—Enceslao J. Contrera
*Attorney, Agent, or Firm*—Cushman, Darby & Cushman

[57] ABSTRACT

A posting device comprising transparent elements fastened parallel to one another to a mounting panel is disclosed. The elements and the panel are preferably made of plastic sheet, to make them flexible, resistant to bad weather and washable. Each element is U-shaped with equal or unequal legs or walls, elastically tilted toward one another, meant to receive strips containing the information to be posted. Adjacent elements are mounted close to each other so that a strip inserted into one of the elements becomes a "captive" thereof. A method to operate the device is also disclosed. It involves lifting the upper wall of an element, inserting the strip containing the information to be posted into the space between the two walls of the element and releasing the lifted wall. Removing the strip is done in an essentially similar fashion. The device can be used to advantage wherever there is a need to post constantly new information.

6 Claims, 4 Drawing Figures

POSTING DEVICE AND METHOD

This is a continuation of application Ser. No. 520,900 filed Nov. 4, 1974, now abandoned.

FIELD OF THE INVENTION

The invention relates to a posting device for posting information, a method for using the device and a component element of the device meant to receive a strip containing the information to be posted.

BACKGROUND OF THE INVENTION

Posting devices known as bulletin boards or notice boards have been used for a long time for posting information. They are generally made of wood and the paper notices to be posted are fastened to the board mostly by means of thumb tacks. These notices often fall off or get removed prematurely. The wooden board becomes full of holes and unpleasant to look at.

OBJECTS OF THE INVENTION

It is thus a main object of the invention to provide a novel posting device and method, to be used in stores, offices, reception rooms etc. for posting ever changing information, for example price lists time schedules etc.

It is a further object of the invention to provide a posting device that holds the posted notice safely in place without any damage to the device.

It is a further object of the invention to provide a posting device which allows the easy and quick insertion and removal of the notices to be posted.

It is a further object of the invention to provide a posting device which is flexible, resistant to bad weather and readily washable, and which is so constructed that it allows stacking of several devices on top of one another.

It is a further object of the invention to provide a posting method which by the use of the posting device of the invention accomplishes the task of posting and removing information easily, quickly, safely and without damage to the board.

SUMMARY OF THE INVENTION

The invention aims at providing a novel posting device which avoids the disadvantages of the known bulletin boards and notice boards in regard to posting and removal of notices, holding the notice in place, keeping the board intact, tackability, washability and resistance to bad weather. The invention also aims at providing a novel posting method which provides for easy, quick and safe operation of the posting device of the invention without any damage to it. These aims are achieved by the posting device of the invention which provides a group of U-shaped elements mounted on a mounting panel in parallel relationship to one another, and intended for receiving strips containing the information to be posted. The walls of the U-shaped elements of equal or varying height are elastically tilted toward each other and hold the strip, once inserted, captive within the space between the walls. The entire device is preferably made of plastic material, providing flexibility washability, and easy handing. The method of the invention involves lifting the upper wall of an element, inserting the strip containing the information to be posted into the space between the walls of the element and releasing the lifted wall.

SPECIFIC DESCRIPTION

The device according to the invention is mainly characterized in that it comprises in combination:

(a) transparent elements, each consisting of a semi-rigid sheet of plastic material having elastic properties, the sheet being folded over itself so as to form two essentially plane walls having similar dimensions and each having an edge parallel to the folding line, and connected with one another by way of a base part constituted by the folding zone and tilted toward each other in such a way, that in their state of rest the walls are close to one another and preferably support one another elastically, and (b) a support panel to which said transparent elements are fastened by way of the outer surface of one of their walls, said transparent elements being disposed parallel to one another on the panel.

A device of this kind may encompass three types of posting boards, namely those of a first type provided with transparent elements having the edge of one of the walls protrude beyond the edge of the other, and being fastened to the panel by way of the outer surface of the non protruding wall; those of a second type provided with transparent units having the edge of one of the walls protrude beyond the edge of the other wall, and being fastened to the panel by way of the outer surface of the protruding wall; and those of a third type having the edges of the two walls coincident.

It should be understood, that the term "base part" has been used in the definition given above out of linguistic expediency and does not refer to the position of the transparent elements relative to the vertical in the position of the posting board exposed to the view of the public.

The edges of each transparent element in relation to the "base part" thereof are preferably directed toward the upper part of the posting board. However, due to the fact, that the edges of the walls of the transparent elements are elastically tilted toward each other it is equally possible to position the posting board in such a way, that the "base part" of each transparent element be oriented in relation to its edge toward the upper part of the posting board.

It should also be understood that whenever the term "edge" is used in the present description, it is intended to refer solely to the outer edge parallel to the folding line.

In accordance with its preferred embodiments, the posting devices of the invention may display the following characteristics taken singly or in combination:

(a) in their state of rest the two walls of the folded plastic sheet form an angle between 2° and 8°, and preferably between 5° and 6°;

(b) the outer diameter of the folding zone of the sheet of plastic material is larger than three times its thickness and smaller than six times its thickness. The fact that the term "diameter" has been used, does not imply that the folding zone is circular. Said term has been used here to refer to the maximum distance between the outer surfaces at the base of the transparent element;

(c) the transparent elements are fastened to the panel in such a way that considering two adjacent elements, these are disposed on the panel in a manner, that if the element wall not fastened to the panel is lifted from said panel, the edge of said wall will lightly touch the base part of the other element;

(d) the panel serving as support to the transparent elements is made of a rigid or flexible material, such as metal or plastic. By preference it is made of a sheet of flexible plastic material;

(e) the plastic elements are made for example of cellulose acetate, nitrocellulose are methacrylic resin. These transparent elements are made according to the classical methods used in the plastics industry;

(f) the transparent elements are fastened to the panel for example by gluing. It is possible, in particular, to fasten the transparent elements to the panel by way of the upper part of the wall only, which is applied to the panel for example by gluing only the upper part of said wall to the panel.

The expression "upper part" of the wall is meant to refer to that part which is directed upwardly in the position of the board exposed to public view.

The invention also concerns the method of use of the posting board of the invention described above, which is mainly characterized in that the wall of a transparent element not directly fastened to the panel is lifted from said panel that a strip containing the information to be posted is inserted between the two walls, and that the lifted wall is allowed to return to it resting position. In order to lift the wall of an element, it is sufficient for example to grasp the edge by hand and to lift it. If the length of the transparent element is small, it may be grasped at its middle and the strip containing the information to be posted may be placed directly in position. If the dimensions of the transparent element are relatively large, the edge may be lifted at one of its extremities, the strip partially inserted and made to slide parallel to the base part of the element until it reaches its desired position, keeping the wall lifted, if necessary, so as to faciliate the sliding of the strip.

The strips used comprise on at least one of their sides information, which may be for example printed or drawn. They may be made of cardboard, of plastic or of metal. Their length is at most equal to the length of a transparent element. Their width is at most equal, in the case of the devices of the first kind defined above, to the distance between the base part of one transparent element and the upper edge of the protruding wall; it is at most equal, in the case of the devices of the second kind, to the distance between the base part of a transparent element and the upper edge of the non-protruding wall; it is at most equal, in the case of the devices of the third kind, to the distance between the base part of a transparent element and the line of coincidence of the two edges. However, it may sometimes be useful to provide for the width of some strips intended for use in conjunction with the devices of the first type to be larger than the distance between the base part and the upper edge of the non-protruding wall of a transparent element, so that the strips end up being pressed together between the two walls and not being capable to slide after they have been put in place. The invention equally concerns a device as previously described, comprizing transparent elements and a mounting panel, characterized in that at least in one transparent element there is a strip inserted between the two walls of said transparent element, said strip having a length at most equal to the length of a transparent element and having a width of most equal, as the case may be, to the distance between the base part of the transparent element and the upper edge of its protruding wall, or to the distance between the base part and the line of coincidence of the two edges, said strip being provided at least on one of its surfaces with signs constituting the visual information to be posted or a part thereof. According to the invention, the maximum width of the strip provided with information depends on the type of the posting board, as indicated above in the preceding paragraph.

The strip containing said information is thus completely enclosed within a volume essentially closed, except for the lateral openings of the transparent element.

The invention equally concerns means for carrying out the posting method described above, comprising a transparent element consisting of a semi-rigid sheet of plastic material, having elastic properties and folded over itself to form two walls having similar dimensions, the walls having edges parallel to the folding line and connected with one another by means of a base part constituted by the folding zone and tilted toward each other in such a way, that in their state of rest the walls are close to one another and by preference support each other elastically.

The posting devices of the invention possess several adavantages, in particular referring to the simplicity of fabrication and use. Other advantages are mentioned below.

It is possible to mount transparent elements on both sides of a single panel.

It is easy to mount on a single panel transparent elements having different dimensions.

Since the edges of the transparent elements are elastically tilted toward one another, it is possible, as previously noted, to arrange the posting board in such a way, that the base part of each transparent element be directed in reference to the edges thereof, either upward or downward with respect to the posting board. In fact, the strip containing the information to be posted ends up imprisoned between the two walls of the transparent element.

Another advantage resulting from the elastic tilt of the edges of transparents elements toward each other is that the posting board is easily washable, for example by means of a sponge imbued with water, without it being necessary to withdraw the strips inserted into the transparent elements. In fact, the washing water cannot penetrate into the inside of a transparent element whose tilted edges insure water tightness.

The tilt of the edges of the transparent elements also permits the storing of the posting boards by stacking them, with the advantage, that one posting board may be made to slide on another posting board without the transparent elements of one getting caught in the transparent elements of the other.

These last two advantages can be achieved in optimum fashion if two adjacent transparent elements of the posting board are such, that if the other wall of one of the elements is lifted, the edge of this wall will lightly touch the base part of the other element.

Finally it is possible to obtain a posting board especially flexible, by using a mounting panel flexible in itself and glueing to it only the upper part of the wall of each transparent element to be applied to the panel.

In the following a particular non restrictive embodiment of a posting device according to the invention is described, with reference to the attached drawing in which.

Figure 1:
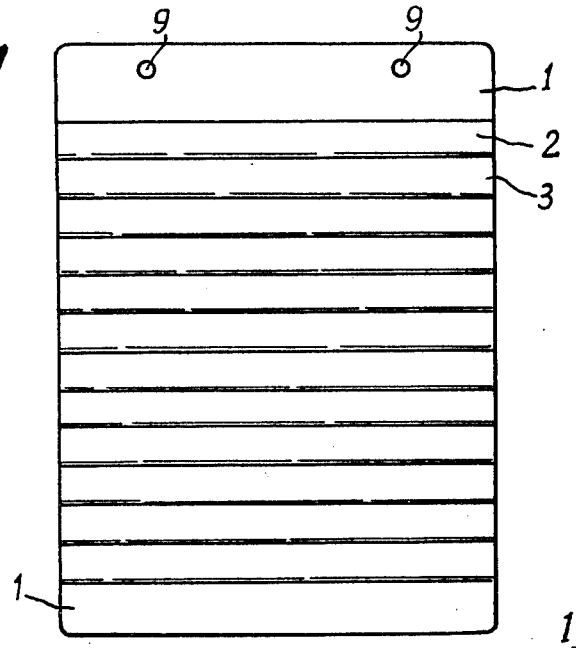
FIG. 1 shows a front view of the posting board

Transparent elements disposed parallel to one another, such as 2 and 3, are fastened to the mounting panel 1 made of plastic material. The mounting panel comprises two holes 9 and 10, serving for the purpose of hooking the board.

The transparent elements are those of the first type mentioned above, that is, they comprise two walls with similar dimensions, such as 4 and 5, the edge of the wall 4 protruding beyond the edge of the wall 5, and each transparent element being fastened to the mounting panel by way of the outer surface of the non protruding wall 5.

The adjacent elements, such as 2 and 3, are close enough to one another, that if the protruding wall 7 of the element 4 is lifted from the board, the upper edge of the wall 7 will lightly touch the base part 6 of the element 2.

Figure 2:
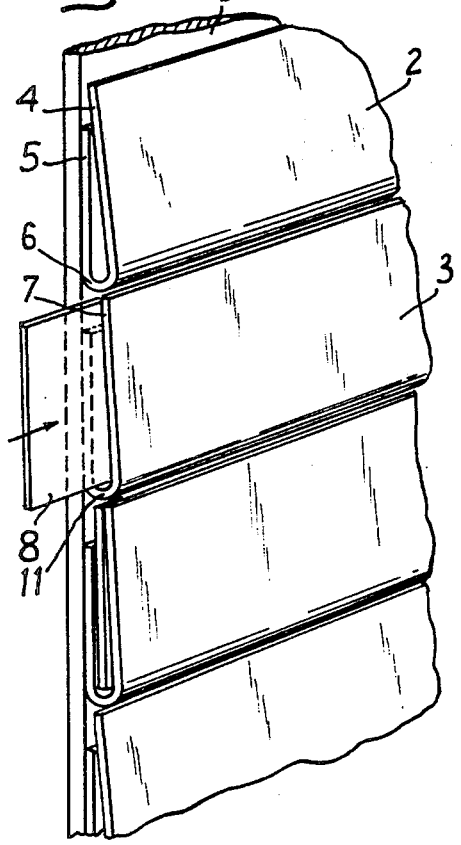
FIG. 2 shows a partial perspective view of a posting board having transparent elements mounted on one side only of the mounting panel
Figure 3:
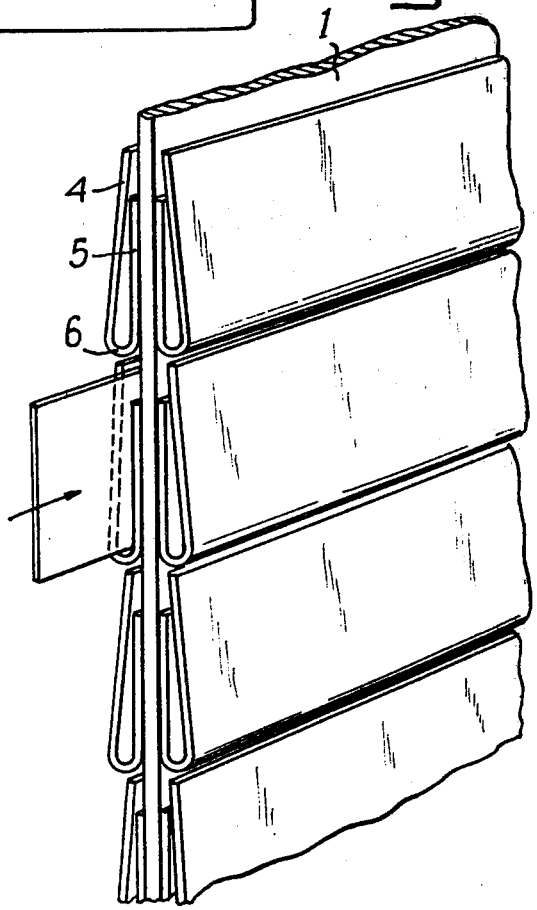
FIG. 3 shows a partial perspective view of a posting board having transparent elements mounted on both sides of the mounting panel.

FIG. 2 shows a cardboard strip 8 in partial engagement between the two walls of the element 3. The information to be displayed is printed on the cardboard strip 8. In order to insert the cardboard strip, the wall 7 was lifted from the board and the strip 8 inserted by making it slide in the direction of the arrow. The width of the strip 8 is slightly smaller than the distance between the base part 11 and the upper edge of the protruding wall 7.

Figure 4:
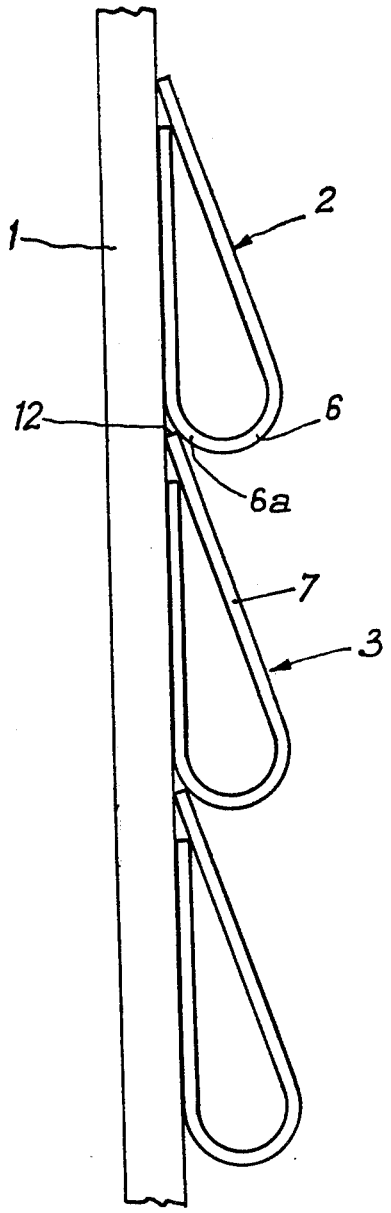
FIG. 4 a partial sectional view through a plane perpendicular to the plane of the posting board.

FIG. 4 shows an embodiment of the posting board of the first type as previously defined, in which the upper edge of the wall not fastened to the mounting panel 1, i.e. of the outer wall 7 of a transparent element 3 if lifted from the panel, will lightly touch the base part 6 of the adjacent transparent element 2 located immediately above. In other words, in this especially preferred embodiment the upper edge 12 of the outer wall 7 is disposed very close to the base part 6 of the element 2, and may even lightly touch said base part 6, said upper edge 12 being normally disposed in the space comprised between the mounting panel 1 and the part 6*a* of the base part 6 which faces the mounting panel. This arrangement assures a water-tightness particularly effective in case of boards subjected to bad weather or when the board is washed with water.

What is claimed is:

1. A posting device comprising in combination:

(a) a plurality of transparent elements, each transparent element consisting of a semi-rigid sheet of plastic material having elastic properties, said sheet being folded over itself so as to form two essentially plane walls wherein each wall has an edge parellel to the folding line and is connected with the other by a base part constituted by the folding zone, said walls being tilted toward each other so that at rest the edges of the walls are close to one another and support one another elastically, and wherein said walls are such that the edge of the outer wall protrudes beyond the edge of the inner wall and wherein each element is affixed to the panel by the outer surface of the non-protruding inner wall, and (b) a supporting panel to which said transparent elements are affixed by the outer surface of the non-protruding wall thereof, said transparent elements being disposed parallel to one another on said panel and wherein immediately adjacent transparent elements are so positioned that the upper edge of the outer wall of one element not affixed to the mounting panel is disposed very near the base part of the immediately above adjacent transparent element or is in actual contact therewith, said upper edge being located within the space comprised between the mounting panel and that portion of said base part of said immediately above adjacent element which faces said mounting panel so as to provide water-tightness when said posting device is subjected to bad weather or is washed with water.

2. The posting device of claim 1 wherein at rest the two walls of the folded plastic sheet form an angle between 2° and 8°.

3. The posting device of claim 2 wherein the said two walls form an angle between 5° and 6°.

4. The posting device of claim 1 wherein the outer diameter of the folding zone is large than three times and smaller than six times the thickness of said sheet.

5. The posting device of claim 1 wherein the transparent elements are affixed to the panel by only the upper part of the outer surface of the non-protruding wall of said transparent elements which face the panel.

6. The posting device of claim 1 wherein in at least one transparent element there is a strip inserted between the two walls of said transparent element, said strip having a length at most equal to the length of said transparent element and having a width at most equal to the distance between the base part of said transparent element and the upper edge of its protruding wall, said strip being provided at least on one of its surfaces with signs constituting the visual information to be displayed or a part thereof.

* * * * *